US006109138A

United States Patent [19]

Upton

[11] Patent Number: 6,109,138

[45] Date of Patent: Aug. 29, 2000

[54] KNIFE BLADES

[75] Inventor: Albert Bryan Upton, Sheffield, United Kingdom

[73] Assignee: McPherson's Limited, Australia

[21] Appl. No.: 08/913,949

[22] PCT Filed: Mar. 28, 1996

[86] PCT No.: PCT/GB96/00752

§ 371 Date: Jan. 6, 1998

§ 102(e) Date: Jan. 6, 1998

[87] PCT Pub. No.: WO96/30173

PCT Pub. Date: Oct. 3, 1996

[30] Foreign Application Priority Data

Mar. 30, 1995 [GB] United Kingdom ..... 9506494

[51] Int. Cl.[7] ..... B21K 11/00; B26B 9/00

[52] U.S. Cl. ..... 76/104.1; 30/350

[58] Field of Search ..... 30/346.53, 346.54, 30/350; 76/101.1, 104.1, DIG. 8

[56] References Cited

U.S. PATENT DOCUMENTS

| | | | |
|---|---|---|---|
| 3,632,494 | 1/1972 | Herte et al. | 204/192.15 |
| 3,635,811 | 1/1972 | Lane | 204/192 |
| 3,911,579 | 10/1975 | Lane et al. | 76/104.1 |
| 3,932,231 | 1/1976 | Hale et al. | 204/181 |
| 4,003,716 | 1/1977 | Steigelman et al. | 428/556 |
| 4,018,631 | 4/1977 | Hale | 148/31.5 |
| 4,139,942 | 2/1979 | Sastri et al. | 30/346.54 |
| 4,330,576 | 5/1982 | Dodd | 76/DIG. 8 |
| 4,653,373 | 3/1987 | Gerber | 83/697 |
| 4,849,300 | 7/1989 | Eriksson et al. | 428/558 |
| 5,427,000 | 6/1995 | Hellbergh | 76/112 |
| 5,431,071 | 7/1995 | Williams | 76/104.1 |
| 5,477,616 | 12/1995 | Williams et al. | 30/350 |
| 5,743,033 | 4/1998 | Gegel | 37/460 |
| 5,766,690 | 6/1998 | Derby et al. | 427/450 |
| 5,806,934 | 9/1998 | Massa et al. | 299/111 |

FOREIGN PATENT DOCUMENTS

| | | |
|---|---|---|
| 0567300A1 | 10/1993 | European Pat. Off. . |
| 92/19424 | 11/1992 | WIPO . |

OTHER PUBLICATIONS

Corresponding International Search Report, International Application No. PCT/GB 96/00752, Jul. 10, 1996.

Corresponding Preliminary Examination Report, International Application No. PCT/GB 96/00752, Jan. 30, 1997.

*Primary Examiner*—M. Rachuba
*Assistant Examiner*—Stephen Choi
*Attorney, Agent, or Firm*—Trexler, Bushnell, Giangiorgi & Blackstone, Ltd.

[57] ABSTRACT

A knife blade including a cutting edge formed on a blank. One side of the edge is provided with a coating formed by a particulate material in a matrix. The matrix is softer than the particulate material, and the coating is such that a considerable number of the particulates project from the matrix thereby defining a cutting tip on the blade edge.

21 Claims, 5 Drawing Sheets

KNIFE BLADES

BACKGROUND OF THE INVENTION

This invention relates to knife blades and to a method of their production.

It has long been known that the surface hardness and wear resistant properties of metal objects can be enhanced by the provision of a hard surface on the metal objects. Thus it is known to generate a carbide and/or nitride enriched or transformed surface, by an appropriate heat treatment, and also known to provide a hard surface coating such as by carburising or nitriding, chemical or physical vapour deposition, electroplating, plasma arc spraying, and other processes.

When considering a knife blade, providing a hard surface particularly at the cutting edge, is difficult to put into practice by any of the techniques outlined above, as a consequence of the very thin sections of blanks ordinarily employed in knife blade construction, and the acute angle to be found at the cutting tip. To take a finished enriched, or transformed hard surface layer, there is the inevitable depletion of carbon from the body of the blade, leaving a blade of thin section with insufficient strength. With surface coatings with a finished blade the relatively small included angle formed at the cutting edge is such that there is an inevitable build-up of coating material at the actual cutting tip and which has a major adverse effect on the sharpness of the blade.

Attempts have been made hitherto to apply a hardened surface to a knife blade such as by a diffusion heat treatment and by vapour deposition of carbides or nitrides. In one known form of construction there has been the treatment of a tapered blank followed by a single wetting or grinding to form a single edge ground or chisel cutting edge that puts the cutting edge in line with one side face of the blank. When subjected to recognised edge testing procedures, such knives have demonstrated no significant improvement in their cutting characteristics in comparison with untreated blades of the same configuration.

Improvements of considerable note have been achieved where a knife blade comprises a V-shaped cutting edge formed on a blank and such that the cutting tip lies substantially centrally of the width of the blank, one side face of the V-shaped cutting edge being provided with a coating of a material harder than the material of the blank, the actual cutting edge being formed wholly of the harder material. EP 92908829.2 discloses a method of forming a blade where a blank is first ground with one face of the V-shaped edge, the ground face is then provided with a hard coating, and the blank is then ground with the other face of the V-shaped edge. EP 93303062.9 improves on this by providing a hard coating having a columnar crystal structure that extends away from the surface of the blank and to the outer face of the coating.

SUMMARY OF THE INVENTION

The object of the present invention is to provide still further improvements in the cutting and edge retention characteristics.

According to the present invention, a knife blade comprises a cutting edge formed on a blank, one side of the edge being provided with a coating formed by a particulate material in a matrix, the matrix being softer than the particulate material, and the coating being such that a considerable number of the particules project from the matrix in the vicinity of the cutting tip of the blade edge, to form the cutting tip.

Preferably, the cutting edge of the knife blade is of generally V shape, and the coating of particulate material and matrix provided on one side only of the V-shaped edge. Thus, a first face of the edge may be ground and coated, and following that, the second face of the edge is ground. Equally, both of the first and second faces of the V-shaped edge can be ground, one side only of the V-shaped edge being provided with a coating, the uncoated side of the V-shaped edge being re-ground after coating has been applied. The generally V-shaped edge may be formed by plunge or flat grinding to both sides, edge grinding to both sides, hollowgrinding to both sides, or the edge may be formed by one grinding technique to one side and a different grinding technique to the other. The blade may be formed from a parallel blank and provided with a centre generally V-shaped cutting edge, or may be a taper or hollowground blade with a whetted generally V-shaped cutting edge.

Preferably, the coating provided to one side of the edge of the blade is a cemented carbide material such as, for example, tungsten carbide particles in a cobalt, or a cobalt/chrome matrix. It will be understood that other carbides and other matrices can be employed.

Further preferably, the cemented carbide material may be sprayed on to one side of the edge of the blade by a high velocity oxy-fuel spray technique, or by a high pressure high velocity oxy-fuel spray technique. Other cemented carbide deposition techniques can also be employed.

When the coating is a cemented carbide such as tungsten carbide, it is preferably composed of 5% to 20% of cobalt or cobalt/chrome and 80% to 95% of tungsten carbide, the coating being applied in a manner that causes the presence of micropores to be distributed throughout the coating, preferably controlled to ensure that the summation of the micro-pores is less than 1% of the total volume of the coating.

To avoid the uneconomic employment of the coating of the invention, it is preferred to limit the coating to one side of a cutting edge. To achieve this, it is preferred to blank the blade and leave exposed the side of the edge to be coated. To maximise production, a blade can be employed to mask a blade behind, a number of blades being loaded in an appropriate jig, with the front blade masked by a masking plate, to leave all of the edges of the blades exposed.

When the coating of the invention is provided by the high velocity oxy-fuel, or high pressure high velocity oxy-fuel, spraying of cemented carbides, the blades should be set in relation to each other such that the blade sides are not in contact, to ensure that the sprayed material does not bond together adjacent blades. Preferably, the direction of the spray is approximately at 90° to the side of the blade edge to be sprayed, but may be set at an acute angle to achieve a slightly greater width of spray coated face on each blade, by spraying a masked blade behind the tip of a masking blade.

The blades may be so positioned in relation to the spray that a number of blades can be simultaneously sprayed, and in one operation provided with a required depth of sprayed material at the cutting edge. To further maximise the production of sprayed blades, a number of jigs, each with a number of blades, can be assembled after the manner of a carousel, and the carousel rotated in front of a spray head. This causes the sequential spraying of blade edges and the progressive build-up of coating thickness until the predetermined thickness of coating is provided.

By having a coating of a hard particulate material bound by a softer matrix, the result is that the cutting tip of the edge is effectively formed by the considerable number of projecting particles of hard material.

The thickness to be achieved is a function of the rate of spraying of the cemented carbide and the rate of rotation of the carousel, i.e. the higher the rotational speed of the carousel the greater is a spray rate required to produce a particular thickness of coating on the blade, the final thickness of coating also being controlled by the number of revolutions of the carousel and hence the number of passes of a blade across the spray.

Desirably, the coating of the invention has a thickness of between 8 and 60 micron, preferably is 25 to 45 micron, and still further preferably 25 to 30 micron. Desirably, the coating has a specific gravity of 12.6.

The invention is based on the recognition that with a particulate material and a matrix softer than the particulate material, micro-wear of the matrix takes place to expose the particulate material, to create by the considerable numbers of particles that are exposed at the cutting tip a cutting edge to a blade that is extremely sharp. The final grind to the uncoated side of the blade either to form the second face of the V-shaped edge, or to re-grind the second face of the V-shaped edge, is such as to generate a microscopically uneven or rough tip at the extremity of the sprayed material, such an uneven or rough initial tip being the primary cause of an extremely sharp initial cutting edge. As the knife is used, the micro-wear of the matrix exposes more and more particles, allows used particles to fall away and be replaced by fresh particles behind them in the matrix. This micro-fragmentation at the edge is assisted by imperceptible but actual wear of the uncoated side of the edge immediately behind the tip to help maintain matrix and particulate material forming the whole of the cutting tip of the blade. Of further assistance is the presence of micro-voids distributed throughout the matrix, the voids taking part in the micro-fragmentation that continuously occurs at the cutting tip as the blade is used.

The net effect is a blade that not so much has an edge that retains its sharpness, but a blade edge that increases in sharpness by use.

Because conventional edge testing has failed to quantify the improvement provided by the invention, considerable efforts have been made to find a way of quantifying the performance of an edge, and allowing a proper comparison with another edge.

Theoretical consideration of the performance data of knives suggests an exponential relationship for the deterioration of the cutting edge with time. In order to test this theory the standard exponential equation given in Eqn (1) below was evaluated adopting the following rational.

$$K=A.e^{-\lambda t} \qquad \text{Eqn 1}$$

where K, A and λ are constants and t is time Plotting K versus t using an arbitrary value for λ gives a classic exponential curve.

By taking logarithms (In) Eqn 1 reduces to $$\text{In } K=-\lambda t+\text{In } A \qquad \text{Eqn 2}$$

A plot of In K versus t gives rise to the linear plot with intercept In A and negative slope λ.

In practice A and K are numerical values usually denoted by $N_o$ and N respectively.

All the knife blades showed deterioration in performance to varying extents. Thus to test this theory on the wear of various knife blades then the following values were defined:

No=the number of strokes to cut the first block

N=the number of strokes to cut a block after 'n' blocks have been cut $N_{test}$=30 being the end of practical testing as a measure of cutting efficiency $N_{cum}$=cumulative number of strokes λ=wear constant In other words the number of blocks 'n' which have been cut is a function of the time, whilst the cumulative number of strokes is proportional to the time taken for each test run.

To illustrate the application of the theory four knives were considered

Knife A—a taper ground blade with a terminal over-ground or whetted V at the cutting edge Knife B—a knife made in accordance with GB(EP) Patent No. 0220362, formed from a parallel blank with a centre V-cutting edge, the cutting edge being plain to one side and formed with serrations/scallops to the other side.

Knife C—a knife made in accordance with EP 93303062.9, formed from a parallel blank with a centre V cutting edge, the cutting edge being plain to one side and formed with serrates/scallops to the other side, the serrated/scalloped side being coated with a material having a columnar crystal structure.

Knife D—the knife as described in A above, one face of the over-ground or whetted V being provided with a coating in accordance with the invention.

DESCRIPTION

Figure 1:
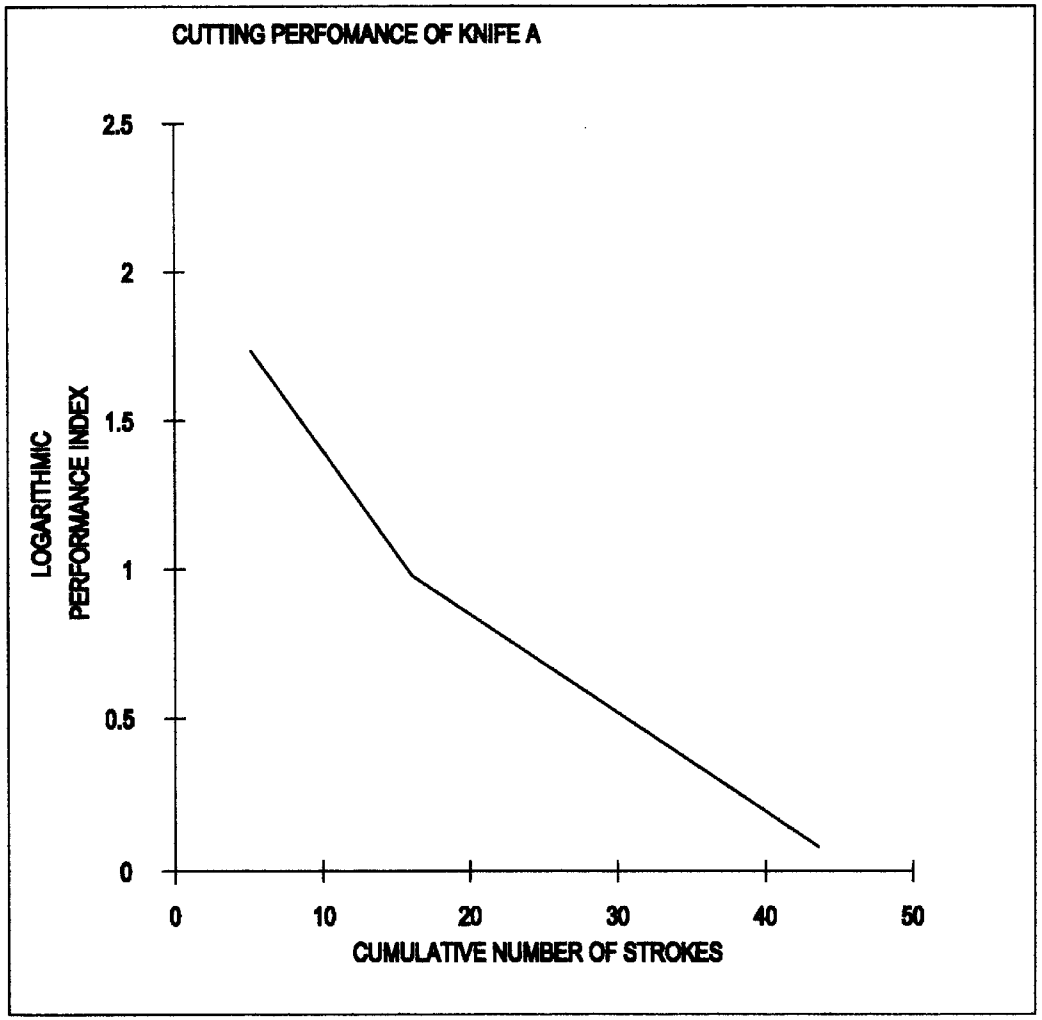
FIG. 1 is a graphical representation of the cutting performance of Knife A.
Figure 2:
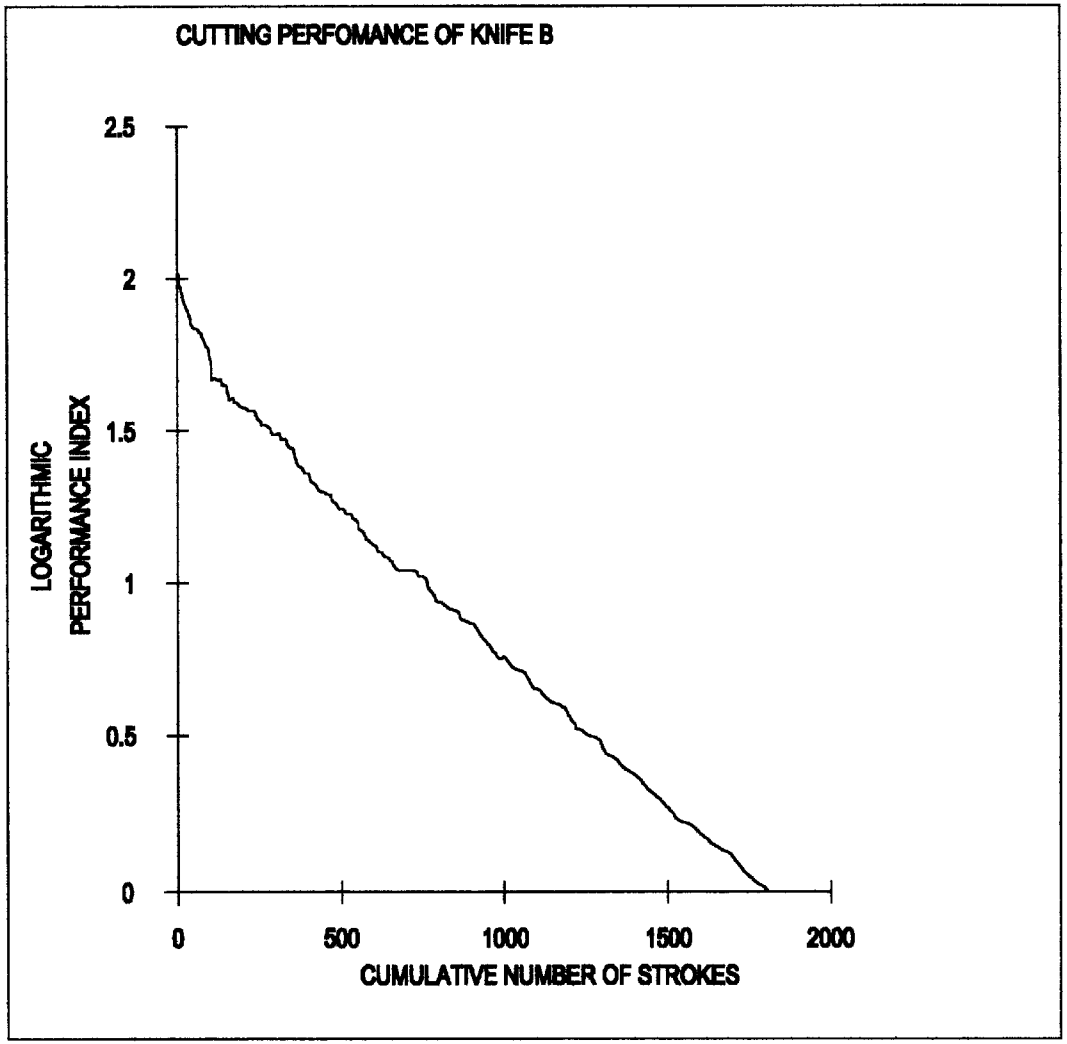
FIG. 2 corresponds to FIG. 1 but shows the cutting performance of Knife B.
Figure 3:
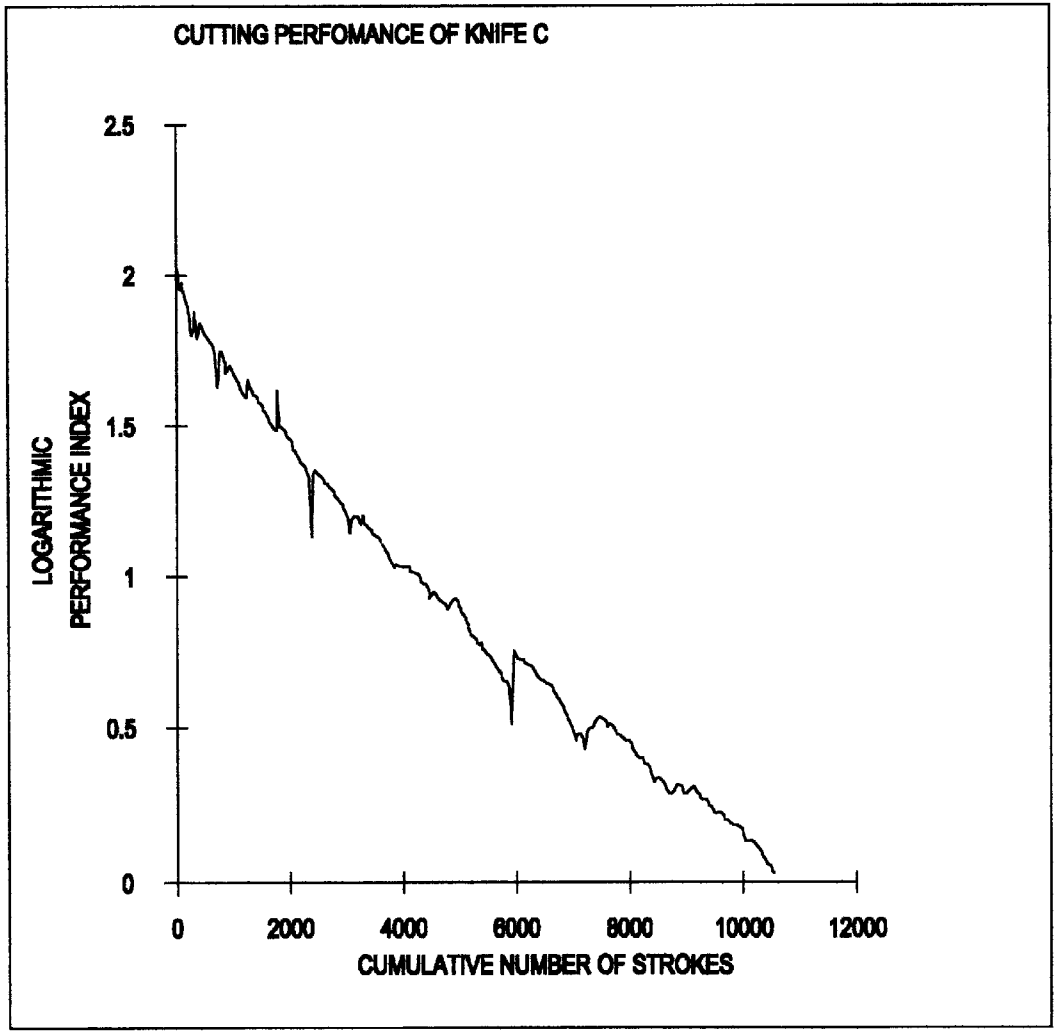
FIG. 3 corresponds to FIG. 1 but shows the cutting performance of Knife C.
Figure 4:
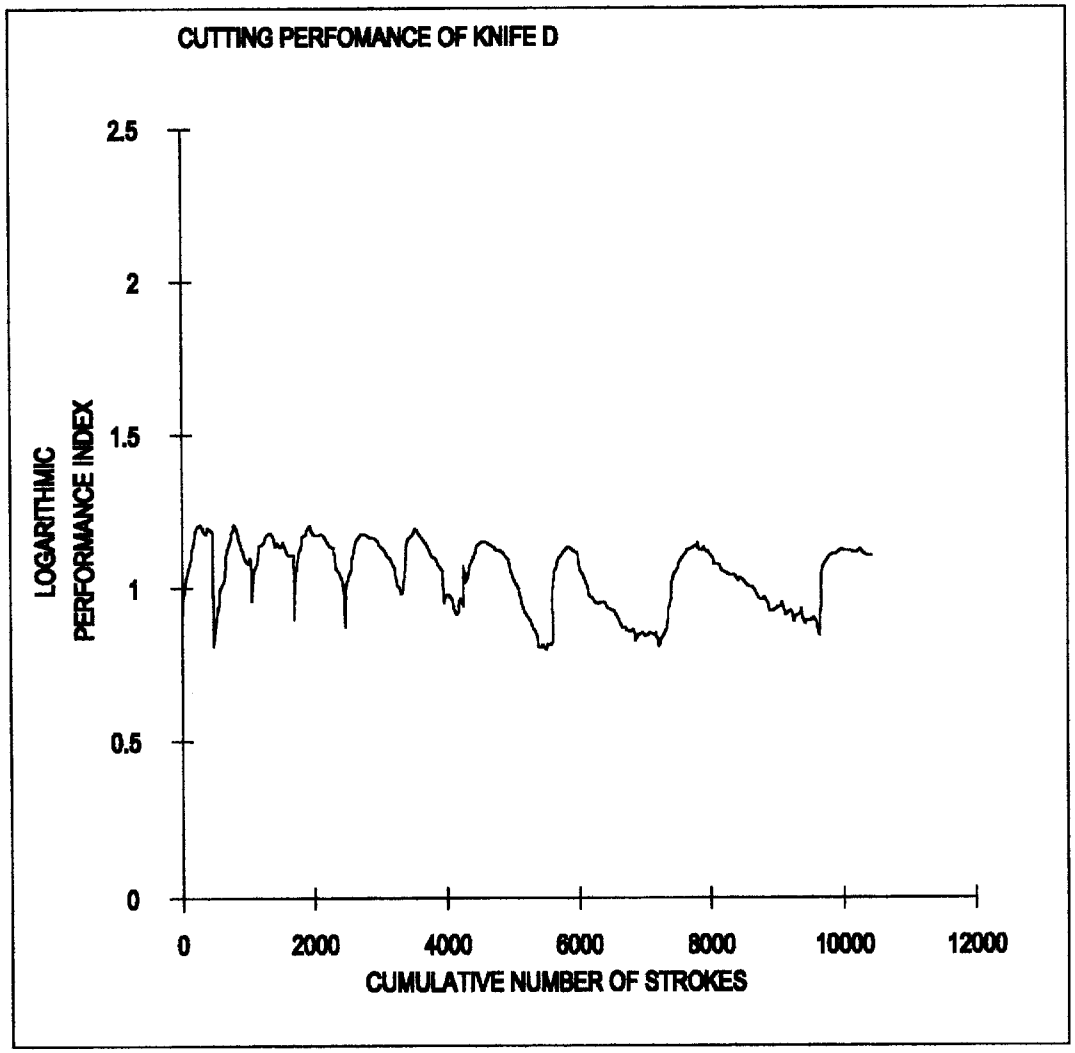
FIG. 4 corresponds to FIG. 1 but shows the cutting performance of Knife D.
Figure 5:
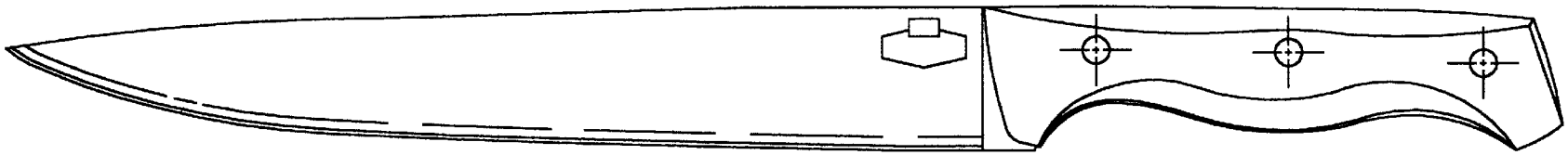
FIG. 5 is a side elevation showing a knife blade in accordance with the invention.

In each of FIGS. 1 to 4 the equation has been further modified such that $$InN_{test}/N=-\lambda t \text{ or}$$

$$InN/N_{test}=\lambda t$$

and InN/Ntest (performance index) has been plotted against $N_{cum}$ (cumulative number of strokes) resulting in a range of lines of varying negative slope.

Whilst there are deviations from strict linearity it is believed that taking into account experimental errors, the close approximation to linearity is sufficient to show that the exponential theory holds true.

Thus the performance of the blades can now be quantified in terms of the slope 'λ' and a value derived for the effective 'half-life'. By 'half-life' is meant a comparative measure of the cumulative number of strokes taken by the blade to reach 50% $N_{test}$.

The following are the derived values of the above knives tested:

| | Approximate Value of λ | Approximate $N_{cum}$ (50% $N_{test}$) |
|---|---|---|
| Knife A | 0.038 | 17 |
| Knife B | 0.0014 | 700 |
| Knife C | 0.00042 | 4500 |
| Knife D | 0.000015 | No perceived deterioration |

It is believed that knife C exhibits the highest sharpness factor and edge retention characteristics of knives known in the prior art. Its approximate $N_{cum}$ at 4500 compared to 700 for knife B which is, in fact, the same knife but with a columnar crystal coating to one side of its generally V-shaped edge, is an adequate demonstration of the notable reduction in edge deterioration exhibited by knife C in comparison with knife B.

Knife D of the present invention is an immeasurable improvement over knife C, and knife D simply cannot be compared with same, but uncoated, knife A.

What is claimed is:

1. A knife blade comprising a cutting edge formed on a blank, one side of the edge being provided with a coating formed by a particulate material in a matrix, the matrix being softer than the particulate material, and the coating being such that a substantial number of the particulate material projects from the matrix thereby defining a cutting tip on the blade edge.

2. A knife blade as in claim 1, wherein the cutting edge of the knife blade is of generally V-shape and the coating of particulate material and matrix is to one side only of the edge.

3. A knife blade as in claim 1, wherein the coating to one side of the edge of the blade is a cemented carbide material.

4. A knife blade as in claim 3, wherein the coating is composed of carbide particles in one of a cobalt matrix and a chrome/cobalt matrix.

5. A knife blade as in claim 4, wherein the coating comprises one of cobalt and chrome/cobalt in the range of 5% to 20%, and comprises carbide particles in the range of 80% to 95%.

6. A knife blade as in claim 1, wherein the coating has a thickness of between 8 and 60 micron, preferably 25 to 45 micron, and still further preferably, 25 to 30 micron.

7. A knife blade as in claim 1, wherein the coating has a specific gravity of 12.6.

8. A method of producing a knife blade in which a cutting edge is formed on a blank, one side of the edge is provided with a coating formed by a particulate material in a matrix, the matrix being softer than the particulate material projects, and the coating being such that a substantial number of the particles project from the matrix in the vicinity of the cutting tip of the blade edge to form a cutting tip, and wherein to limit the coating to one side of the cutting edge, the blade is blanked to leave exposed the side of the edge to be coated.

9. A method as in claim 8, wherein a blade is employed to mask a blade behind, a number of blades being loaded in an appropriate jig with the front plate masked by a masking plate to leave all of the edges of the blades exposed.

10. A method as in claim 8, wherein a required depth of coating is provided in one operation.

11. A method as in claim 8, wherein a number of coats are applied successively to build up a coating of a required thickness.

12. A method of forming a knife blade comprising: forming a cutting edge on a blank, said cutting edge having a first face and a second face; applying a coating to said first face of the cutting edge, wherein the coating comprises a particulate material in a matrix, the matrix being softer than the particulate material, and the coating being such that a substantial number of the particulate material projects from the matrix thereby defining a cutting tip.

13. A method of forming a knife blade as in claim 12, wherein the cutting edge of the knife blade is of generally V-shape; and the method comprises applying the coating to only one of said first face and said second face.

14. A method of forming a knife blade as in claim 12 or claim 13, further comprising grinding said second face after applying the coating to said first face.

15. A method of forming a knife blade as in claim 14, further comprising re-grinding said second face after applying the coating to said first face.

16. A method of forming a knife blade as in claim 12 or claim 13, wherein at least one of said first and second faces are one of plunge ground and flat ground.

17. A method of forming a knife blade as in claim 12, further comprising at least one of edge grinding and hollow grinding at least one of said first and second faces.

18. A method of forming a knife blade as in claim 12, further comprising forming the coating by using at least one of a plasma spray technique, a high velocity oxy-fuel spray technique and a high pressure high velocity oxy-fuel spray technique.

19. A method of forming a knife blade as in claim 12, wherein the coating has micropores distributed throughout the coating.

20. A method of forming a knife blade as in claim 19, further comprising controlling the micropores to ensure that a summation of the micropores is less than 1% of a total volume of the coating.

21. A method of forming a knife blade as in claim 12, further comprising generating a tip at an extremity of the coating where the tip is at least one of microscopically uneven and rough.

* * * * *